US008783575B2

(12) United States Patent
Finlayson et al.

(10) Patent No.: US 8,783,575 B2
(45) Date of Patent: Jul. 22, 2014

(54) USE OF ZIGBEE PERSONAL AREA NETWORK IN MILES MANWORN

(75) Inventors: James B. Finlayson, Temecula, CA (US); Nicholas D. Schlarbaum, San Diego, CA (US)

(73) Assignee: Cubic Corporation, San Diego, CA (US)

( * ) Notice: Subject to any disclaimer, the term of this patent is extended or adjusted under 35 U.S.C. 154(b) by 1465 days.

(21) Appl. No.: 11/779,213

(22) Filed: Jul. 17, 2007

(65) Prior Publication Data

US 2012/0183928 A1 Jul. 19, 2012

Related U.S. Application Data

(60) Provisional application No. 60/807,808, filed on Jul. 19, 2006.

(51) Int. Cl.
*G06K 19/00* (2006.01)

(52) U.S. Cl.
USPC ..... 235/472.02; 235/435; 235/439

(58) Field of Classification Search
USPC ..... 235/400–418
See application file for complete search history.

(56) References Cited

U.S. PATENT DOCUMENTS

| | | | | |
|---|---|---|---|---|
| 5,426,295 | A | 6/1995 | Parikh et al. | |
| 5,474,452 | A | 12/1995 | Campagnuolo | |
| 5,788,500 | A | 8/1998 | Gerber | |
| 6,065,404 | A | 5/2000 | Ripingill, Jr. et al. | |
| 2004/0005531 | A1 * | 1/2004 | Varshneya et al. | 434/11 |
| 2004/0014010 | A1 * | 1/2004 | Swensen et al. | 434/21 |
| 2004/0080433 | A1 * | 4/2004 | Nitzan et al. | 340/945 |

FOREIGN PATENT DOCUMENTS

WO WO 2008-144244 A2 11/2008

OTHER PUBLICATIONS

Le, Khanh, "Designing a zigbee-ready IEEE 802.15.4-compliant radio transceiver," RFDesign, Electronic Design Group, Nov. 2004, pp. 42-50 (retrieved from http://rfdesign.com/mag/radio_designing-zigbeeready-ieee/), entire document.

User's Manual: "MILES 2000 After Action Review System (MARS)", Cubic Defense Systems, Inc., (1992) rev. Mar. 15, 1998, pp. 1-48; downloaded from the Internet at [www.cubic.com/cda1/pdf/MAARs%20Manual%20compiled.pdf] on Nov. 1, 2007.

Product description: Miles 2000—Small Arms Transmitter (SAT), pp. 1-2; downloaded from the Internet at [www.peostri.army.mil/PRODUCTS/MILES/FILES/SmallArmsTransmitter.pdf] on Nov. 1, 2007.

* cited by examiner

*Primary Examiner* — Matthew Mikels
(74) *Attorney, Agent, or Firm* — Kilpatrick Townsend & Stockton LLP

(57) ABSTRACT

A wireless laser detection system for use in a military training environment and method of implementing the same are described. The wireless laser detection system includes at least one laser detector module characterized by a sensor, a decoder, and a network adapter. The laser detection system also includes a control module and a status indicator. The sensor detects an information bearing laser signal and communicates it to the decoder. The decoder extracts event data from the laser signal and sends it to the network adapter. The network adapter wirelessly transmits the event data over a personal area network to the control module. The control module processes the event data and stores it in a memory. The control module also optionally downloads the stored event data to an external device.

27 Claims, 9 Drawing Sheets

USE OF ZIGBEE PERSONAL AREA NETWORK IN MILES MANWORN

CROSS-REFERENCES TO RELATED APPLICATIONS

This application claims the benefit of U.S. Provisional Application No. 60/807,808, filed Jul. 19, 2006, entitled USE OF ZIGBEE PERSONAL AREA NETWORK IN MILES MANWORN, which is hereby incorporated herein by reference in its entirety.

BACKGROUND OF THE INVENTION

The Multiple Integrated Laser Engagement System (MILES 2000®) produced by Cubic Defense Systems, Inc. exemplifies a modern, realistic force-on-force training system. As a standard for direct-fire tactical engagement simulation, MILES 2000 is used by the United States Army, Marine Corps, and Air Force. MILES 2000 has also been adopted by international forces such as NATO, the United Kingdom Ministry of Defence, the Royal Netherlands Marine Corps, and the Kuwait Land Forces.

MILES 2000 includes wearable systems for individual soldiers and marines as well as devices for use with combat vehicles (including pyrotechnic devices), personnel carriers, antitank weapons, and pop-up and stand-alone targets. The MILES 2000 laser-based system allows troops to fire infrared "bullets" from the same weapons and vehicles that they would use in actual combat. These simulated combat events produce realistic audio/visual effects and casualties, identified as a "hit," "miss," or "kill." The events may be recorded, replayed and analyzed in detail during After Action Reviews which give commanders and participants an opportunity to review their performance during the training exercise. Unique player ID codes and Global Positioning System (GPS) technology ensure accurate data collection, including casualty assessments and participant positioning.

MILES 2000 individual laser detection systems include small, lightweight laser detectors mounted on either a vest or an H-harness. The laser detectors are wired to an amplifier and the amplifier is optically coupled to an electronics assembly. Wires connecting the individual laser detectors to the amplifier are sewn or otherwise attached to the vest or harness. This arrangement can be appreciated with reference to commonly-assigned U.S. Pat. No. 5,426,295 issued to Parikh et al. which is incorporated herein by reference.

MILES 2000 also includes vehicle-mounted laser detection systems that function in a similar manner. Vehicle-mounted systems generally include one or more laser detectors that are wired together and attached to a belt assembly. The belt assembly is designed to create a hit profile characteristic of a particular type of combat vehicle. Thus, different detector belts may be required for use with different combat vehicles. Alternatively, a universal belt system may be used and individual laser detectors may be arranged on the belt according to vehicle type.

Wired connections limit the flexibility of the MILES 2000 system. Presently, disassembly and, in some cases, alteration of the supporting belt or harness may be necessary to change the number and placement of the laser detectors in relation to the amplifier and electronics assembly. Thus, there is a need in the art for a wireless laser detection system that avoids these limitations.

BRIEF SUMMARY OF THE INVENTION

A wireless laser detection system and method of implementing a wireless laser detection system are disclosed. The wireless laser detection system includes at least one detector module characterized by a sensor, a decoder, and a network adapter. The wireless laser detection system also includes a control module, a memory, and a status indicator. The sensor detects a laser signal and communicates it to the decoder. The decoder extracts event data from the laser signal and sends it to the network adapter. The network adapter transmits the event data over a wireless personal area network to the control module. The control module receives the event data over the wireless personal area network. The control module processes the event data and stores it in the memory.

In another embodiment of the wireless laser detection system, the control module is configured to form the personal area network and to act as the network coordinator. In such an embodiment, the control module adds and removes laser detector modules from the personal area network. The control modules may also associate weapon systems with the wireless laser detection system. In some embodiments, the control module is adapted to download event data from the memory to an external device.

Additional embodiments of the wireless laser detection system are adapted to be worn by a human being or mounted on a vehicle. In an exemplary manworn embodiment, the wireless laser detection system includes four laser detector modules arranged so that one detector is located on each side of the head, one detector is located on the chest, and one detector is located on the back. In a further embodiment, a laser detector module is disposed in the control module and the combination is worn on the head.

In another embodiment, a method for implementing a wireless laser detection system is disclosed. The method includes forming a personal area network having a control module as the network coordinator, associating at least one laser detector module with the control module to enable wireless communication over the personal area network, detecting a laser signal at the laser detector module, and decoding event data from the laser signal. The method also includes transmitting event data from the laser detector module to the control module over the wireless personal area network, processing the event data at the control module, storing the event data in the control module, and providing information about the status of the system.

In another embodiment, the method for implementing a wireless laser detection system includes a step of updating in which laser detectors and small-arms transmitters (SATs) are added or removed from the personal area network by the control module. In some embodiments, operation of a SAT may be enabled or disabled. The method may optionally include a step of downloading event data to an external device.

In another embodiment, the method for implementing a wireless laser detection system includes distributing laser detector modules in a manworn configuration so that one detector module is placed on each side of the head, one detector module is placed on the chest, and one detector module is placed on the back. In additional manworn embodiments, a laser detector module is disposed in the control module and the control module is adapted to be worn on the head. In still other embodiments, the method includes adapting the wireless laser detection system for use with a vehicle.

Figure 1:
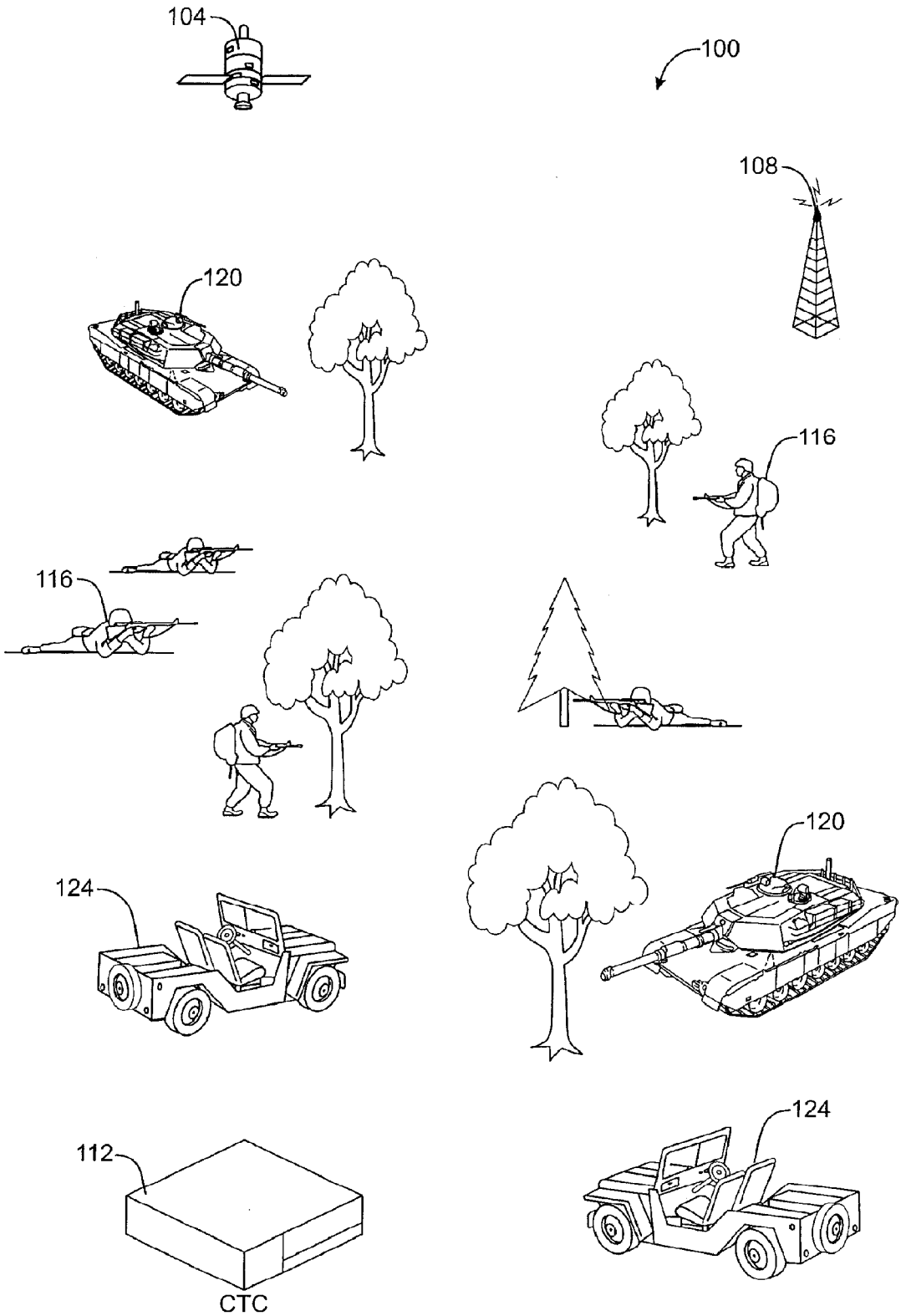
FIG. 1 depicts a combat training exercise in which manworn and vehicle mounted embodiments of the present invention may be utilized.

The features, objects, and advantages of embodiments of the disclosure will become more apparent from the detailed description set forth below when taken in conjunction with the drawings. In the drawings, like elements bear like reference labels. Various components of the same type may be distinguished by following the reference label with a dash and a second label that distinguishes among the similar components. If only the first reference label is used in the specification, the description is applicable to any one of the similar components having the same first reference label irrespective of the second reference label.

DETAILED DESCRIPTION OF THE INVENTION

A wireless laser detection system for use in a military training environment and method of implementing the same are disclosed. The wireless laser detection system includes at least one laser detector module characterized by a sensor, a decoder, and a network adapter. The wireless laser detection system also includes a control module, a memory, and a status indicator. In operation, the sensor detects an information bearing laser signal which it communicates to the decoder. The decoder extracts event data from the laser signal and sends it to the network adapter. The network adapter wirelessly transmits the event data over a personal area network to the control module. The control module processes the event data and stores it in the memory. The control module may also be configured to download the event data to an external device for review and analysis.

FIG. 1 depicts a combat training exercise 100 in which manworn and vehicle mounted embodiments of the present invention may be utilized. GPS satellite 104 provides location and positioning data for each participant in combat training exercise 100. Data link 108 relays this information to combat training center 112. Combat training center 112 is a place where real-time information about the training exercise is collected and analyzed. Combat training center 112 may also communicate tactical instructions and data to participants in the combat training exercise through data link 108.

A wireless laser detection system is associated with each soldier 116 and vehicle 120, 124 in the training exercise. The wireless laser detection system uniquely identifies the soldier 116 or vehicle 120, 124 and may communicate with one or more GPS satellites 104 to provide location and positioning data. Wireless laser detection systems generally include one or more laser detector modules for detecting simulated weapons fire and a control module for processing and storing data related to battlefield events. In some embodiments, wireless laser detection systems include a radio frequency (RF) transceiver for detecting fire from simulated area weapons or other indirect devices. Thus, for example, combat training center 112 may generate signals that simulate one or more artillery shells exploding in a particular location. RF transceivers integrated with the laser detection systems of individual soldiers 116 or vehicles 120, 124 at that location may register a hit based upon their proximity to the shell and surrounding objects.

Wireless laser detection systems may also be configured to control the operation of weapon systems. In some embodiments, a weapon is not activated for use in the training exercise until it has been associated with a laser detection system. Thus, when a soldier acquires a new weapon, for example, his or her wireless laser detection system may initiate an association process. The association process communicates information to the weapon system that identifies the soldier. Thereafter, soldier-specific event data may be included with the laser bullets fired by the weapon. Event data carried by laser bullets may, among other things, identify the soldier who fired the weapon and the type of weapon that was fired.

A wireless laser detection system may not allow a soldier to fire a weapon if the soldier has been designated as killed or disabled. For example, a small-arms transmitter (SAT) in the soldier's possession may require permission from his or her wireless laser detection system before it can be fired. If a soldier is hit and deemed to be killed by the combat simulation system, the wireless laser detection system may not grant permission to fire the small-arms transmitter. Vehicle-mounted weapons systems may also need permission from a laser detection system before they will operate. For example, the laser detection component of a combat vehicle system may control a universal laser transmitter mounted on the vehicle. If the vehicle sustains a simulated hit and is considered to be disabled, its laser detection system may disable further use of vehicle-mounted weaponry.

Figure 2A:
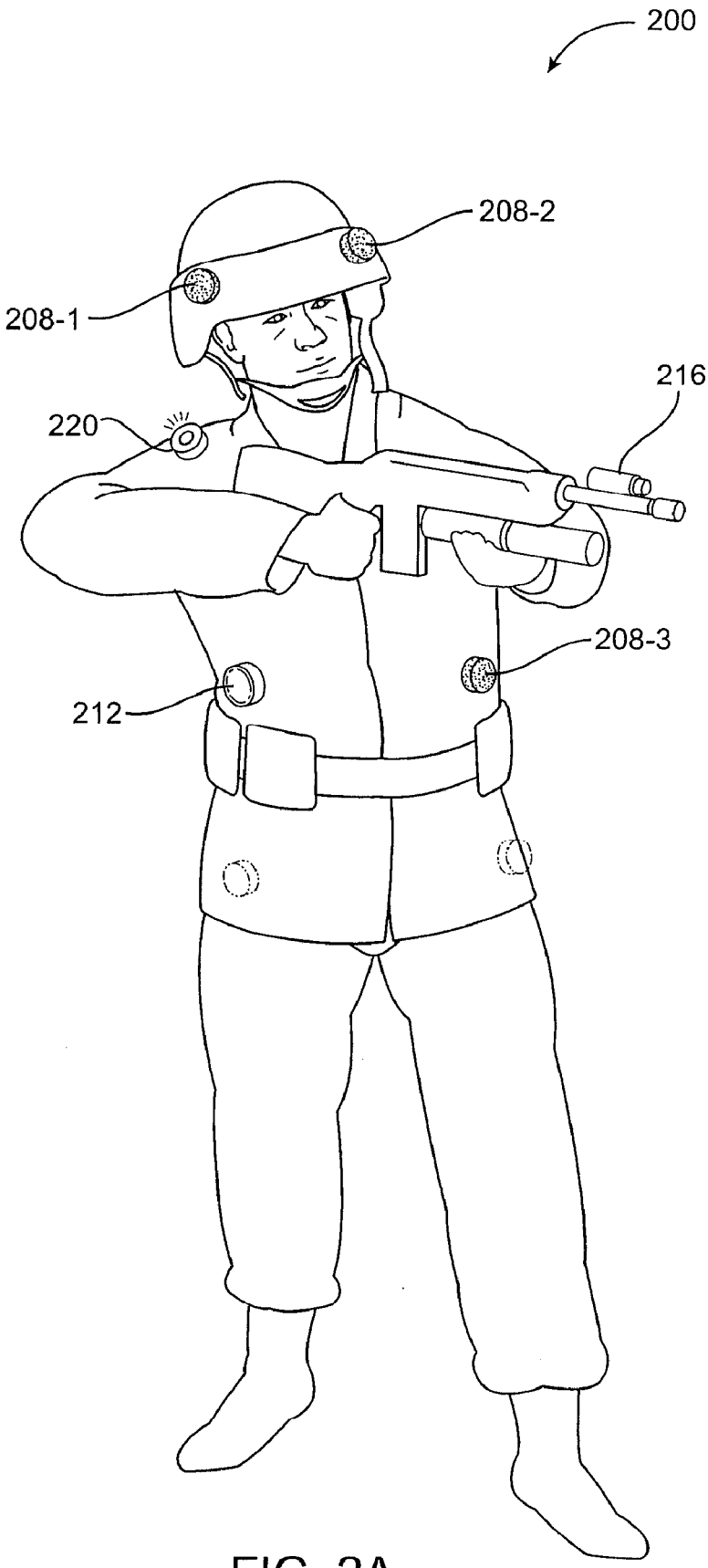
FIGS. 2A and 2B are manworn embodiments of a wireless laser detection system in accordance with the present invention.

FIG. 2A is a manworn embodiment 200 of a wireless laser detection system in accordance with the present invention. Soldier 204 is shown outfitted with laser detector modules 208, control module 212, and small-arms transmitter (SAT) 216. Status indicator 220 is also shown. Laser detector modules 208, control module 212, and small-arms transmitter 216 are not physically connected. Instead, each component can exchange messages as part of a wireless personal area network (PAN). Laser detector modules 208 detect direct-fire events and communicate event data wirelessly to control module 212 over the personal area network. Small-arms transmitter 216 can also communicate over the personal area network and may, for example, send network messages to control module 212 requesting permission to fire.

A typical manworn configuration of laser detector modules 208 includes two laser detector modules 208-1, 208-2 worn on the helmet, one laser detector module 208-3 worn on the chest, and one laser detector module worn on the back (not shown). This arrangement provides adequate coverage in most training situations. It is understood, however, that number and position of the laser detector modules may be changed and that these changes do not require any components of the system to be rewired. For example, a tank operator may be outfitted with a manworn laser detection system having laser detector modules mounted on the helmet only. A sniper, on the other hand, may wear a different number or arrangement of laser detector modules according to his or her location. In each case, the laser detector modules communicate wirelessly with the control module and the use of a specialized belt, harness, or vest is not required.

In some embodiments, control module 212 forms the wireless personal area network and acts as a central point for receiving messages carried on the network. As shown, control module 212 may be a separate module or it can be integrated with a laser detector module. Additional laser detector modules 208 and/or small-arms transmitters 216 may be added to the personal area network before a training exercise begins. For example, an association process may be performed in which each device is registered and receives addressing information needed to communicate on the personal area network. In specific embodiments, this process is initiated by an infrared (IR) signal from control module 212. The IR signal may place a device into association mode and provide a random value used to initiate network communications. This process may be repeated during the training exercise as a soldier acquires new weapons or equipment. In other embodiments, a device such as a small-arms transmitter may actively initiate association with the control module by transmitting an IR signal that includes a random value.

Control module 212 may be associated with several laser detectors and weapon systems within the personal area network, and the communications between devices will be confined to the personal area network with which they are associated. Furthermore, because control module 212 wirelessly associates the different modules to the personal area network, the modules are not constrained to any particular orientation or configuration, as is typical in a wired network such as those used with harness-based systems. Although the description focuses on associating a number of laser detection modules 208 and a small arms transmitter 216 with control module 212, the system is not limited to such modules. For example, a manworn embodiment may also include one or more physical monitors. Each physical monitor can be associated with a particular control module 212. A physical monitor can be configured, for example, to monitor a soldier's heart rate, temperature, blood pressure, and the like, or some combination of parameters. The physical monitor can communicate the monitored parameters to the associated control module 212 for monitoring or data storage.

Status indicator 220 provides information about the status of a participant in the training exercise. In some embodiments, this information is communicated as audible or visual cues. For example, a buzzer may sound or an LED may flash to indicate that a participant has been hit or killed. Different tones or colors may signify a near miss or that the participant has been disabled. Also, wireless laser detection system 200 may include a "cheat-detect" feature through which status indicator 220 indicates tampering with light or sound. In some embodiments, status detector 220 may include a display panel for communicating detailed instructions or status information to the participant. By way of illustration, the display panel may identify a participant's status and, in the event that the participant is deemed killed or injured, the type of weapon that killed or injured the participant. In some embodiments, status indicator 220 is further adapted to display real-time messages dispatched from combat training center 112.

Figure 2B:
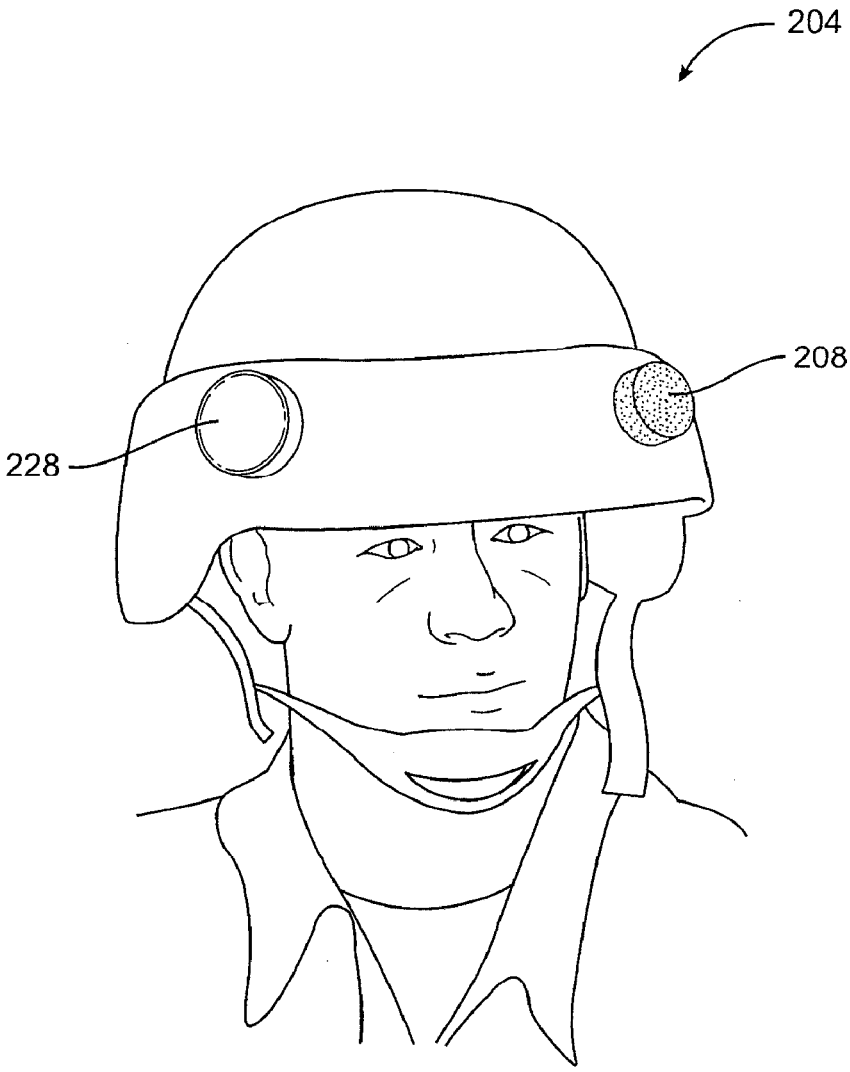

FIG. 2B is a manworn wireless laser detection system 204 according to another embodiment of the present invention. In this embodiment, a control module and a detector module are combined into a single module 228 that provides dual functionality. Laser bullets incident upon the combined module 228 are processed directly by the co-located control module and need not be transmitted over the personal area network for use elsewhere in the wireless laser detection system. Combined module 228 receives event data messages from dedicated laser detector modules 208 over the personal area network and, in other respects, may function similarly to the dedicated control module 212 of FIG. 2A. In a preferred arrangement, combined module 228 is worn on the helmet to improve communication with laser detector modules 208. Positioning control modules on the helmet may reduce interference from the body of the participant and may, therefore, reduce the amount of battery power required to operate a dedicated control module 212 or a combined module 228.

Figure 3:
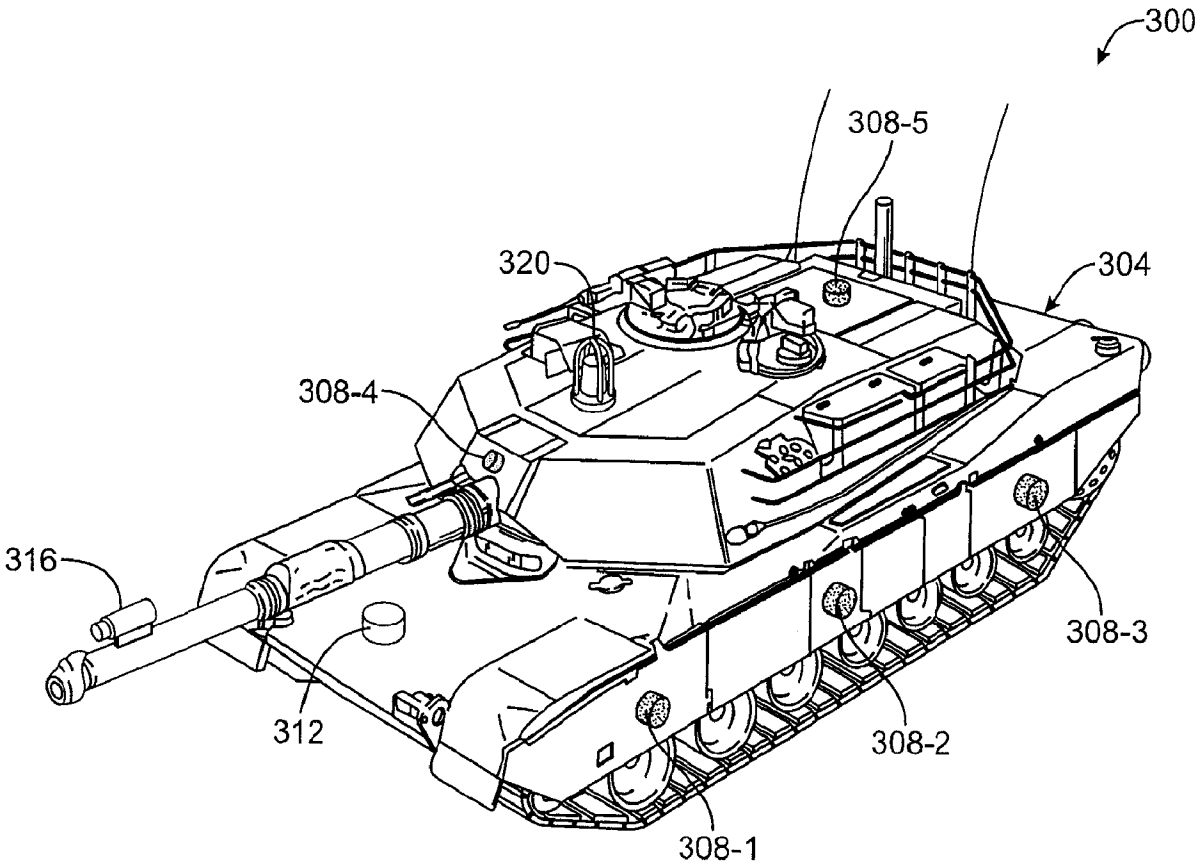
FIG. 3 is a vehicle-mounted embodiment of a wireless laser detection system according to an embodiment of the present invention.

FIG. 3 is a vehicle-mounted embodiment 300 of a wireless laser detection system according to a further embodiment of the present invention. In this embodiment, laser detector modules 308 are adapted for use with combat vehicle 304 and are intended to replace vehicle detector belts found in wired laser detection systems. Vehicle mounted laser detector modules 308 may be relatively larger in size than their manworn counterparts and may also be equipped with fastening means to simplify attachment to a vehicle's exterior. Similar to manworn embodiments, vehicle-mounted laser detector modules 308 communicate wirelessly with control module 312 over a personal area network comprising the various parts of the vehicle-mounted system. Control module 312 can also communicate with a weapon system 316 and status indicator 320. Status indicator 320, for example, may function in a similar manner as manworn status indicator 220 or may be a single-function device designed to provide a kill status indicator visible from a distance while weapon system 316 may simulate the effect of different types of vehicle-mounted weaponry.

Figure 4:
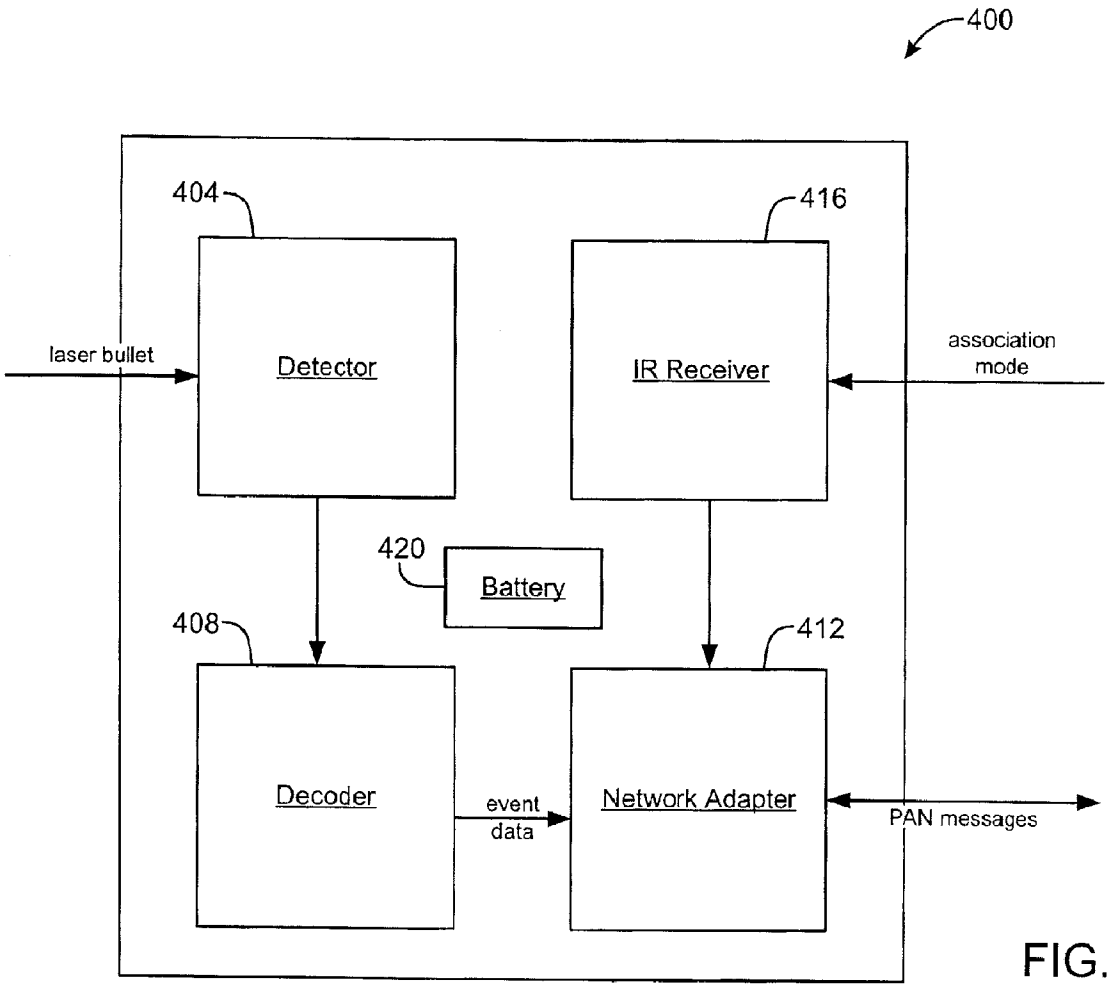
FIG. 4 is a functional block diagram of a laser detector module according to one embodiment of the present invention.

FIG. 4 is a functional block diagram of a wireless laser detector module 400 according to one embodiment of the present invention. As shown, the various elements of laser detector module 400 are powered by a rechargeable battery 420. Laser detector module 400 detects an input signal at detector 404. Detector 404 is sensitive to specific wavelengths of electromagnetic radiation and produces an electrical signal when illuminated by these wavelengths. In some embodiments, detector 404 is sensitive to infrared laser pulses such as those used to simulate direct-fire weapons in the MILES 2000 training system. However, detector 404 may be configured to recognize other types of signals and may be configured to operate at different wavelengths.

Electrical signals from detector 404 are sent to decoder 408. Decoder 408 extracts event data from the electrical signals which may include information related to the training exercise. For example, the electrical signals may represent an identifier of the participant who fired the laser bullet as well as a type of weapon fired. In some embodiments, this event data may be specially coded. Exemplary embodiments of the detector module can be configured to detect and process event codes used in the MILES 2000 system and may thus be integrated with other components of a MILES 2000 training system.

Event data from decoder 408 is provided to network adapter 412 for transmission over a wireless personal area network (not shown). Network adapter 412 provides a wireless link to a control module with which wireless laser detector module 400 has been associated. Messages containing decoded event data are formed according to a network protocol and transmitted wirelessly over the personal area network to the control module. These network messages may include an address of the control module and other network parameters set during the association process. In an exemplary embodiment, the physical and media access control layers of the wireless personal area network conform to the IEEE 802.15.4 standard and the higher-level networking layers are managed by ZigBee™ wireless technology.

Wireless laser detector module 400 also includes IR receiver 416. IR receiver 416 may be used in an association process whereby laser detector module 400 is added to a wireless personal area network. In some embodiments, association is initiated when IR receiver 416 recognizes an association request. The association request may, for example, represent a random number received as part of an IR signal. The random number may be provided to network adapter 412 and used to initiate RF communication. In this way, the wireless laser detector module 400 may join a personal area network. For example, a participant in a training exercise may be given a number of laser detector modules 400 and a control module to be used during the exercise. The participant may place the control module into association mode and proceed to associate each individual laser detector module with the control module. In some embodiments, the control module may be configured to automatically associate with a number of laser detector modules when placed into the association mode. After the association process is completed, each wireless laser detector module has the information necessary to transmit event data to the control module over the wireless personal area network.

Figure 5A:
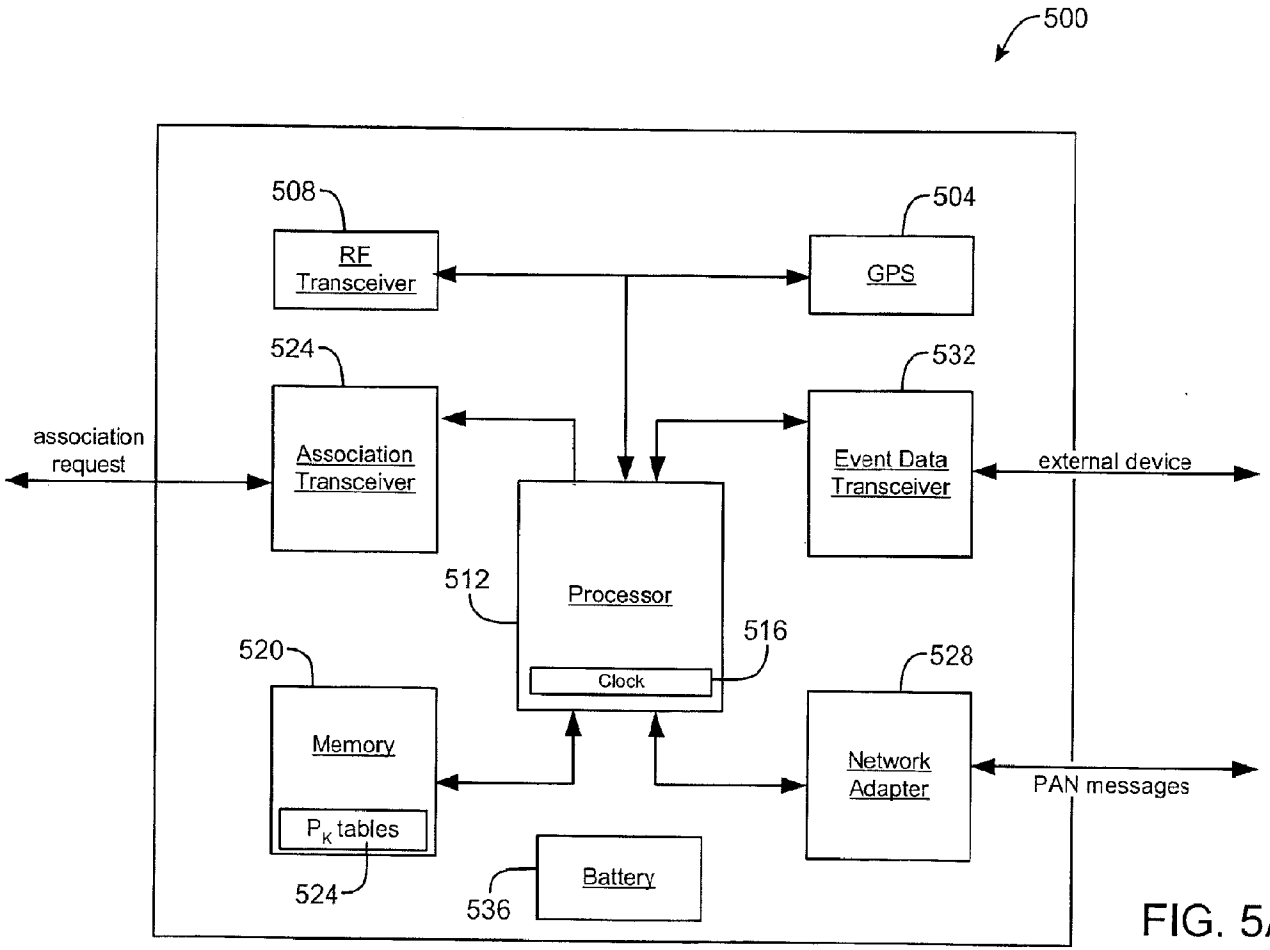
FIGS. 5A and 5B are functional block diagrams of control modules forming part of a wireless laser detection system according to embodiments of the present invention.

FIG. 5A is a functional block diagram of a control module 500 according to an embodiment of the present invention. As shown, the various parts of control module 500 are powered by a rechargeable battery 536. Control module 500 is the nerve center of the wireless laser detection system and may perform multiple functions including: establishing the personal area network and acting as network coordinator, associating laser detector modules with the personal area network, and receiving network messages containing event data from laser detector modules. Control module 500 can also be configured to process, store, and download event data. In addition, control module 500 may associate weapons systems, such as small-arms transmitters, with the personal area network and control their operation.

Some embodiments of control module 500 include a GPS transceiver 504 for communicating with a GPS satellite. GPS transceiver 504 may communicate location information to a GPS satellite which may transmit positioning data for a participant in the training exercise to a control training center or centralized data collection facility. Positioning data from the GPS satellite may be time-stamped and received at the combat training center in near real-time. When the training exercise is complete, positioning data from the GPS satellite may be combined with event data gathered from individual participants and used to perform a detailed after-action review. As shown, GPS transceiver 504 can be coupled with a processor 512. Processor 512 may receive location and positioning data from GPS transceiver 504, combine this information with event data, and store the results in a memory 520. Event data stored in memory 520 may be downloaded to an external device.

100391 Control module 500 may also include an RF transceiver 508. RF transceiver 508 may perform two separate functions. First, RF transceiver 508 may establish a communication link and operate to exchange voice and data traffic between participants in the training exercise and the control center. This communication link may also be used to dispatch operational instructions or data to a participant or group of participants on a simulated battlefield. In addition, RF transceiver 508 may be used to simulate the effect of area weapons. Thus, RF transceiver may receive a signal representing a grenade or artillery shell landing in the vicinity of the participant. Data from RF receiver 508 is communicated to processor 512 and used to determine a hit, miss, or kill event. In some embodiments, processor 512 accesses programmable probability-of-kill tables 524 stored in memory 520 to determine the effect of the indirect-fire RF data. Different probability-of-kill values can be used depending upon whether a participant is identified as wearing body-armor or is unprotected. Processor 512 may time-stamp communication or indirect fire events with reference to internal clock 516 and store a record of these events in memory 520. In some embodiments, memory 520 is a flash memory module or similar storage electronic medium.

Control module 500 also includes an association transceiver 524 for generating and receiving association requests. Association requests may be used to initiate the process by which a laser detection module is added to a wireless personal area network. Control module 500 coordinates the wireless personal area network and manages the association process. In some embodiments, processor 512 generates a random value and transmits this value to surrounding devices through association transceiver 524. Association transceiver 524 encodes the random value in a short-range IR signal that can be detected by an IR receiver located in a laser detector module. In one embodiment, the laser detector module responds to the association request by re-transmitting the random value in an RF signal. Control module 500 may then reply to the RF transmission by providing a network identifier or other addressing information to enable the responding laser detector module to join the personal area network.

Control module 500 can associate a weapon system with the personal area network in a similar manner. Weapons must generally be associated with a laser detection system before they can be used in a combat training exercise. In some embodiments, the association process is initiated when a participant attempts to fire a weapon system. If the weapon system has not been associated with the participant's laser detection system, the weapon system may begin transmitting an association request. Association transceiver 524 may receive and respond to the association request. In some embodiments, processor 512 recognizes an association request from a weapon system and causes association transceiver 524 to transmit a random value. If the weapon system responds by re-transmitting the random value as part of an RF signal, control module 500 may provide a network identifier or other addressing information to enable the responding weapon system to communicate over the personal area network. In addition, processor 512 may also cause association transceiver 524 to transmit information about the participant to the weapon system. The weapon system may store this identifying information and include it as part of the event data added to laser bullets. In some embodiments, identifying information is sent to the weapon system over the wireless personal area network after the association process has been completed.

Weapon systems may request permission to fire from the control module 500 each time they are activated. In some embodiments, a weapon sends a request to control module 500 over the wireless personal area network in advance of being fired. Control module 500 may prospectively enable or disable the weapon according to the participant's status. For example, if the participant has been killed or disabled, the control module may not enable the weapon to be fired. On the hand, if the participant is active, control module 500 may permit the weapon to fire and subsequently store details of the firing event in memory 520. In some embodiments, processor 512 may receive and respond to firing requests through association transceiver 524. In other embodiments, processor 512 may receive and respond to firing requests by exchanging messages with the weapon system over the wireless personal area network.

Network adapter 528 sends and receives message on the wireless personal area network and may include a combination of hardware and software elements. In a preferred embodiment, network adapter 528 implements a multi-layer protocol stack in which the physical and media access control layers conform to the IEEE 802.15.4 standard and the higher layers implement ZigBee™ wireless technology. This combination provides a standards-based, low-power approach to network communications and is well suited for use with battery powered devices such as the control and laser detector modules of the wireless laser detection system. In addition, this combination of technology provides built-in support for handling association and dissociation from the personal area network and also provides a collision avoidance scheme and multiple security services. These features can reduce device complexity and thereby improve overall reliability when the system is used in combat training conditions. Although discussed in the context of specific network technologies, it will be understood that network adapter 528 may implement other networking technologies without departing from the spirit of the invention.

In some embodiments, control module 500 acts as personal area network (PAN) coordinator and is responsible for forming the personal area network. As PAN coordinator, control module 500 may choose a radio channel and select a network identifier for the personal area network. This information, along with other network parameters, may be sent to laser detector modules 208, 308 or weapon systems 216, 316 during the association process enabling these devices to communicate on the network. In addition, control module 500 may actively listen for and respond to messages from devices on the personal area network. In some embodiments, network adapter 528 monitors the operating frequency for messages containing the selected network identifier and sends only these messages to processor 512 for further action. In this way, control module 500 is able to disregard messages addressed to other network devices that may be operating on the same frequency.

Processor 512 receives messages containing event data from network adapter 528. Event data may be received from a laser detector module and may indicate that incoming fire was detected. If a participant was hit by incoming fire, processor 512 may further determine whether he or she is deemed to have been killed or disabled. In some embodiments, processor 512 makes this determination by accessing probability-of-kill tables 524 stored in memory 520. The event data may include information identifying a participant who fired the weapon and a type of weapon used. This information may be contained in separate fields of a network message or may be represented by a code. Some embodiments use MILES 2000 codes to communicate event data and may therefore be used with other components as part of a MILES 2000 training system. Processor 512 stores event data in memory 520 and may also time-stamp each event with reference to internal clock 516.

Control module 500 can also be configured to download event data to an external device and to receive inputs from an external device. This interaction may be accomplished in two ways. First, control module 500 may associate the external device with the personal area network and may exchange messages with the external device over the personal area network. Thus, for example, messages containing all or portions of the event data stored in memory 520 may be sent to an external device over the personal area network. Alternatively, control module 500 may exchange information with an external device by means of event data transceiver 532. In some embodiments, event data transceiver 532 provides an infrared link over which event data stored in memory may be downloaded. Data from the external device may also be uploaded to control module 500 through event data transceiver 532. For example, a control gun may provide a participant identification code to the control module and, in some situations, may be used to resurrect a killed participant during a training exercise.

Figure 5B:
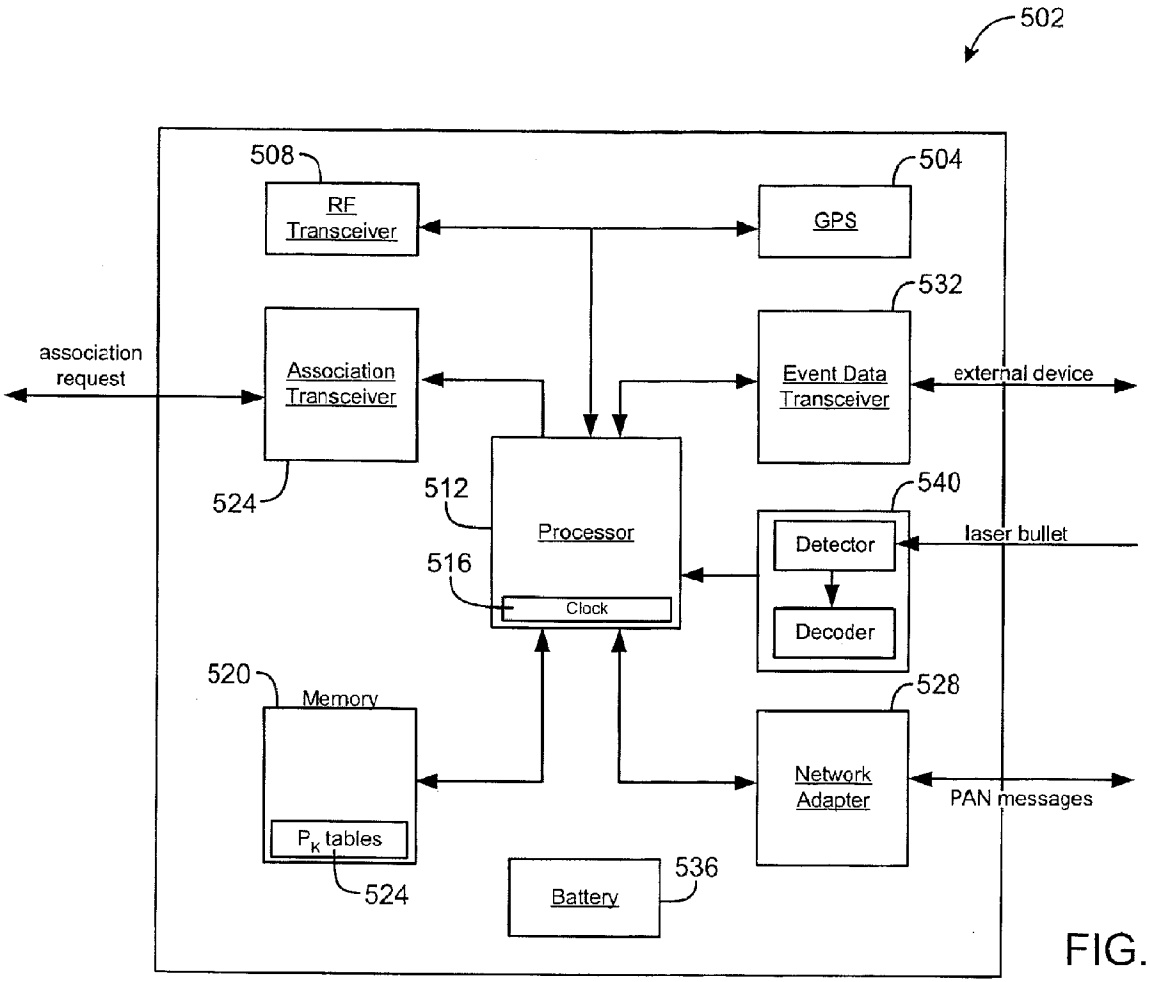

FIG. 5B is a functional block diagram of a control module 502 according to a further embodiment of the present invention. Control module 502 is generally similar to control module 500 but additionally includes detector block 540. Detector block 540 enables control module 502 to detect and decode laser bullets. Thus, in this embodiment, control module 502 performs the functions of both a laser detector and a dedicated control module. Detector block 540 detects a laser bullet, decodes event data from the laser bullet, and communicates the decoded event data directly to processor 512. In this embodiment, event data decoded by detector block 540 need not be transmitted over the wireless personal area network.

Figure 6:
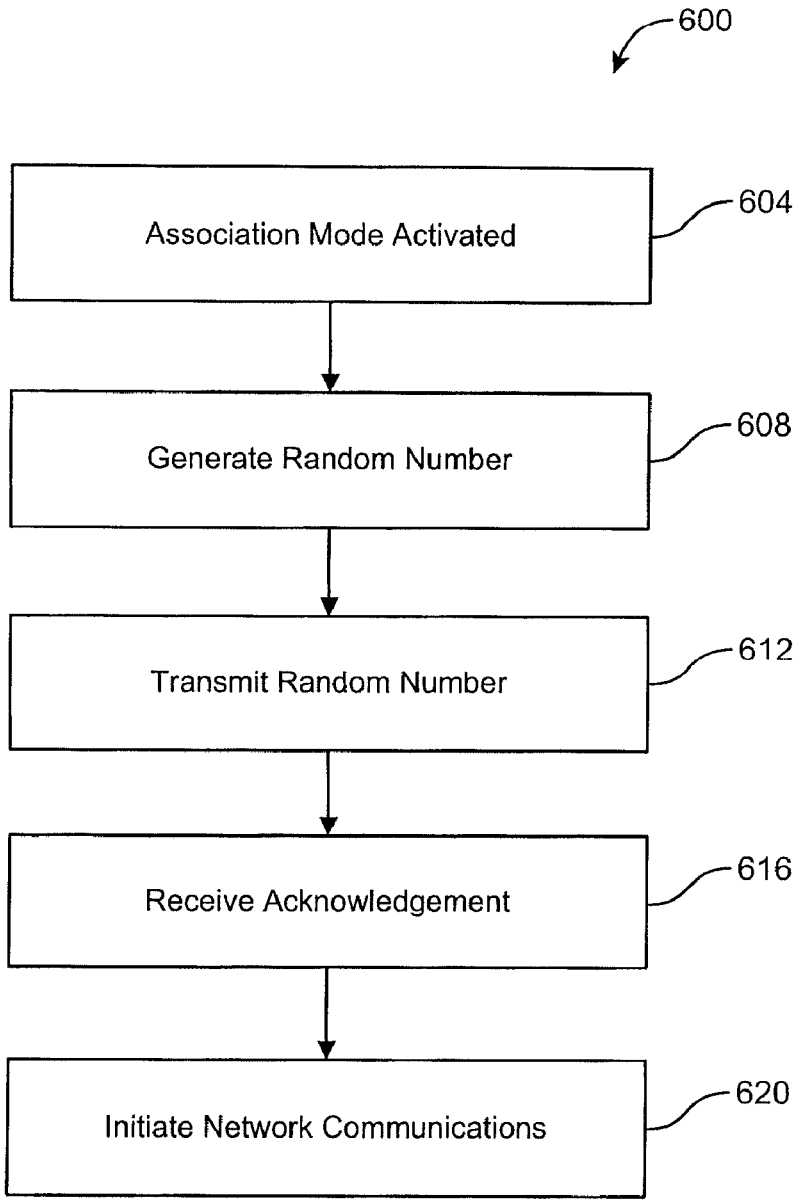
FIG. 6 is a flowchart of an embodiment of a process by which a laser detector module is associated with a wireless laser detection system.

FIG. 6 is a flowchart of an embodiment of a process by which a laser detector module such as that shown in FIG. 4 is associated with a wireless laser detection system. In a first step 604, the wireless laser detection system is placed into association mode. This may be done, for example, through a user interface included as part of the control module. Upon entering association mode, the wireless laser detection system may generate a random number 608 for initiating communication with a target device. In a next step 612, the random number is transmitted as part of an association request to the target device. In some embodiments, the random number is transmitted by a short-range infrared signal that is designed to minimize interference from other devices.

After the random number has been transmitted, the wireless laser detection system waits to receive acknowledgement 616 from the target device. A laser detector module, for example, may acknowledge the association request by retransmitting the random number on a predetermined RF frequency. When the association request has been acknowledged, the wireless laser detection system initiates network communications 620 with the target device. This may include, for example, transmitting addressing and security information to enable a target device to communicate over the personal area network.

Figure 7:
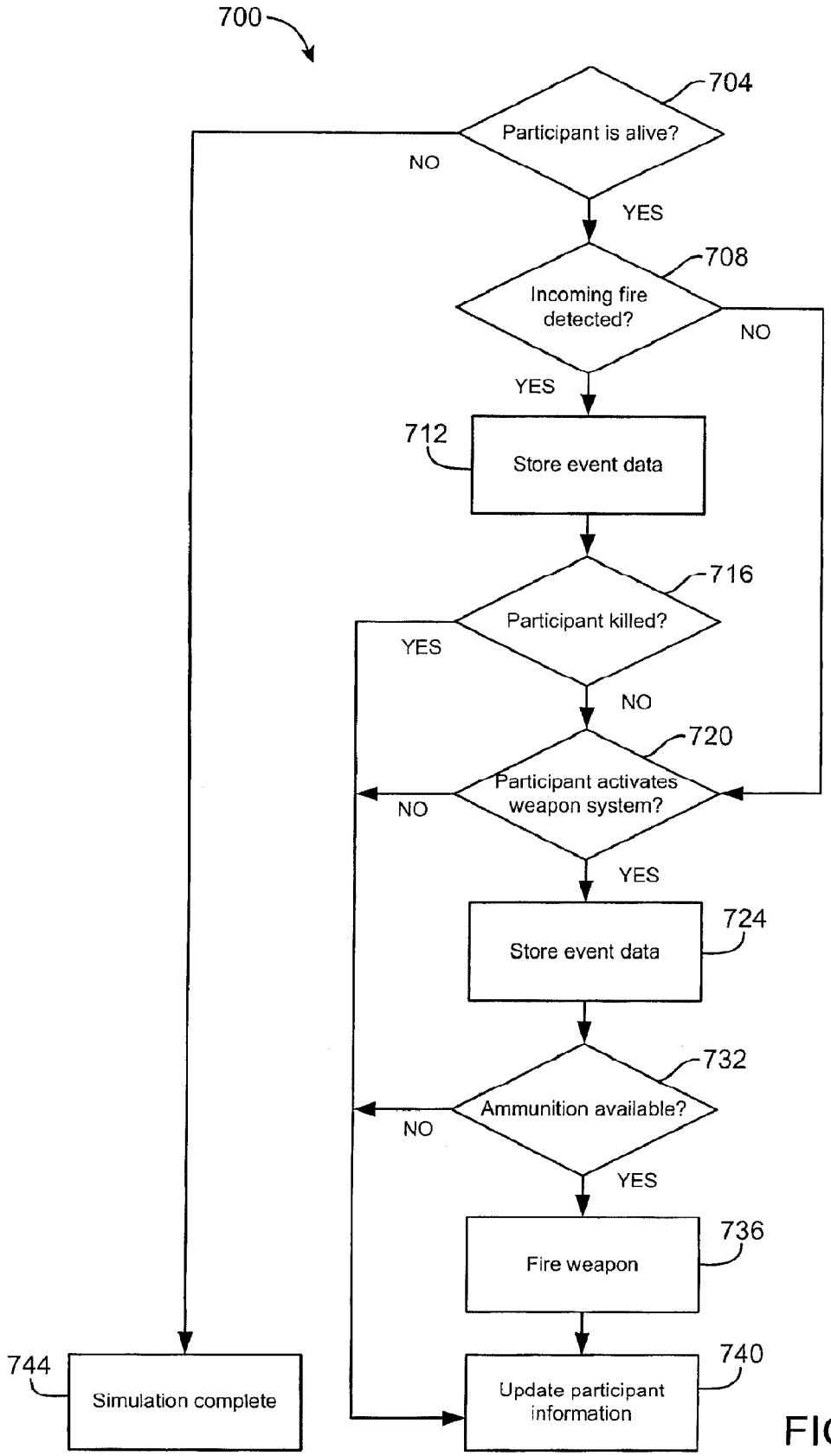
FIG. 7 is a flowchart of an embodiment of steps performed by a control module processing event data.

FIG. 7 is a flowchart of an embodiment of steps performed by a control module such as shown in FIGS. 5A-5B. In a first step 704, the control module determines whether a participant is alive and therefore an active participant in the training exercise. If the participant has been killed or seriously injured, the control module may indicate that the simulation is complete 744 and thereafter disregard events generated by the participant. If the participant is still active in the simulation, the control module determines whether incoming fire has been detected 708 at any of the laser detector modules associated with the participant's wireless laser detection system. This may involve listening for network messages for a predetermined interval of time. In some embodiments, the control module may actively query associated laser detector modules to determine whether incoming fire has been detected. If incoming fire is detected, the control module stores data 712 associated with the event. Event data may include, for example, an identification number of the participant who fired the weapon and information about the type of weapon and the ammunition that was used. In some embodiments, event data may include MILES 2000 system codes.

If incoming fire was detected 708, the control module determines its effect. For example, incoming fire may represent a direct hit or a near miss. Also, in some embodiments, the effect of incoming fire may depend upon other factors such as whether the participant is wearing body armor. The control module processes all of this information and determines if the participant was killed 716. If the participant was killed 716, the control modules updates information about the participant in system memory 740 and event processing is complete.

In a next step 720, the control module determines if the participant has activated a weapon system. This may involve, for example, pulling the trigger on a small-arms transmitter or activating a vehicle-mounted weapon. If the participant activates a weapon system, the control module stores data 724 about the event in system memory. Event data may include a time at which the weapon was activated and an identification of the participant that activated the weapon. In some embodiments, the control module also determines the amount of ammunition that is available 732 to the participant. For example, if all ammunition has been expended, the control module may deactivate the weapon system and store a record of the event. On the other hand, if sufficient ammunition is available, the weapon is fired 736. In a next step, the control module updates the player status information 740 and the event processing cycle is complete.

The above description of the disclosed embodiments is provided to enable persons of ordinary skill in the art to make or use the disclosure. Various modifications to these embodiments will be readily apparent to those of ordinary skill in the art. It is understood that the generic principles described herein may be applied to other embodiments without departing from the spirit or scope of the disclosure. Thus, the disclosure is not limited to the particular embodiments described herein but is to be accorded the widest scope consistent with the principles and novel features disclosed.

Persons of ordinary skill in the art will understand that steps of a method or process described in connection with the embodiments disclosed herein may be embodied directly in hardware, in software executed by a processor, or in a combination of hardware and software. The various steps or acts in a method or process may be performed in the order shown, or may be performed in another order. Additionally, one or more process or method steps may be omitted or one or more process or method steps may be added to the methods and processes. An additional step, block, or action may be added to the beginning, end, or between existing elements of a method and process.

What is claimed is:

1. A wireless detection system for use in a military training environment, the system comprising:

two or more laser detector modules each including:

a sensor configured to detect a laser signal, a decoder configured to extract event data from the laser signal, and a network adapter configured to transmit the event data from the decoder over a wireless personal area network (WPAN) and to receive signals over the WPAN;

a control module configured to:

form the WPAN, act as the network coordinator for the WPAN, associate devices including the two or more laser detector modules with the WPAN, receive the event data transmitted from the laser detector modules over the WPAN, transmit signals to the devices associated with the WPAN, and process the event data;

a memory coupled with the control module and configured to store the processed event data; and a status indicator configured to provide status information to a human operator, wherein the control module and the two or more laser detector modules are adapted to be attached to a single user simultaneously and to operate independently from each other, and wherein the control module limits access to the WPAN to the devices attached to the single user.

2. The wireless detection system for use in a military training environment recited in claim 1, wherein the WPAN comprises IEEE 802.15.4 wireless technologies.

3. The wireless detection system for use in a military training environment recited in claim 1, wherein the control module is further configured to add or remove devices from the WPAN.

4. The wireless detection system for use in a military training environment recited in claim 3, wherein the devices added or removed include the two or more laser detector modules, a physical monitor, and a small-arms transmitter.

5. The wireless detection system for use in a military training environment recited in claim 3, further comprising an infrared transceiver and wherein the control module is configured to add devices to the WPAN using the infrared transceiver.

6. The wireless detection system for use in a military training environment recited in claim 4, wherein the control module is configured to enable or disable operation of the small-arms transmitter.

7. The wireless detection system for use in a military training environment recited in claim 1, wherein the event data includes a MILES 2000 code.

8. The wireless detection system for use in a military training environment recited in claim 1, wherein the control module is further configured to download event data stored in the memory to an external device.

9. The wireless detection system for use in a military training environment recited in claim 1, wherein the status indicator further comprises a display module for providing the status information to the human operator.

10. The wireless detection system for use in a military training environment recited in claim 1 comprising at least four distinct laser detector modules attached to a human user, wherein the laser detector modules are arranged with one detector located on each side of the head, one detector located on the chest, and one detector located on the back.

11. The wireless detection system for use in a military training environment recited in claim 10, wherein at least one laser detector module is disposed in the control module and the control module is worn on the head.

12. The wireless detection system for use in a military training environment recited in claim 1, wherein the laser detector modules and the control module are adapted to be attached to a vehicle.

13. A method for implementing a wireless detection system, the method comprising:

forming a wireless personal area network (WPAN) having a control module as the network coordinator;

associating, by the control module, devices including at least two laser detector modules with the WPAN to enable communication over the WPAN, wherein the devices are adapted to be attached to a single user;

limiting access to the WPAN, by the control module, to devices attached to the single user;

detecting a laser signal at one or more of the laser detector modules;

decoding event data from the laser signal;

transmitting the event data from the one or more laser detector modules to the control module over the WPAN;

processing the event data at the control module;

storing the event data in the control module; and providing information about the status of the wireless detection system.

14. The method for implementing a wireless detection system recited in claim 13, wherein the wireless personal area network comprises IEEE 802.15.4 wireless technologies.

15. The method for implementing a wireless detection system recited in claim 13, further comprising a step of updating in which devices are added or removed from the WPAN.

16. The method for implementing a wireless detection system recited in claim 15, wherein the devices added or removed to the WPAN include a laser detector module and a small-arms transmitter.

17. The method for implementing a wireless detection system recited in claim 16, further comprising a step of enabling or disabling operation of the small-arms transmitter.

18. The method for implementing a wireless detection system recited in claim 13, further comprising a step of downloading event data to an external device.

19. The method for implementing a wireless detection system recited in claim 13, wherein the information about the status of the wireless detection system includes audio or visual signals.

20. The method for implementing a wireless detection system recited in claim 13, wherein the laser detector modules and the control module are adapted to be worn by a human being.

21. The method for implementing a wireless detection system recited in claim 20, further comprising a step of distributing the laser detector modules so that one laser detector module is placed on each side of the head, one laser detector module is placed on the chest, and one laser detector module is placed on the back.

22. The method for implementing a wireless detection system recited in claim 21, wherein a laser detector module is disposed in the control module and the control module is located on the head.

23. The method for implementing a wireless detection system recited in claim 14, further comprising steps of adapting the laser detector modules and the control module to be attached to a vehicle.

24. A wireless detection system for use in a military training environment, the system comprising:

two or more manworn modules configured to be attached to a single user and to monitor a predetermined parameter and communicate information related to the predetermined parameter over a wireless personal area network (WPAN) with which the two or more manworn modules are associated; and a manworn control module configured to be attached to the single user, to associate and communicate over the WPAN with the two or more manworn modules, to associate the two or more manworn modules with the WPAN, to act as the network coordinator for the WPAN, and to limit access to the WPAN to manworn modules attached to the single user.

25. The wireless detection system for use in a military training environment recited in claim 24, wherein the two or more manworn modules each comprise a laser detection module configured to determine receipt a predetermined laser signal and report an occurrence of the predetermined laser signal to the manworn control module over the WPAN.

26. The wireless detection system for use in a military training environment recited in claim 24, wherein the control module is configured to enable or disable a small arms transmitter.

27. The wireless detection system for use in a military training environment recited in claim 24, wherein the control module is configured to associate a previously unassociated manworn module with the WPAN.

* * * * *